US006138416A

United States Patent [19]

Platt

[11] Patent Number: 6,138,416

[45] Date of Patent: Oct. 31, 2000

[54] BEAM

[75] Inventor: William J. Platt, Aston, Pa.

[73] Assignee: Worthington Armstrong Venture, Malvern, Pa.

[21] Appl. No.: 09/190,640

[22] Filed: Nov. 12, 1998

[51] Int. Cl.[7] ..... E04B 9/06; E04C 3/02; F21S 8/06

[52] U.S. Cl. ..... 52/28; 52/506.07; 362/150; 362/404

[58] Field of Search ..... 52/28, 506.07, 52/731, 7; 362/150, 217, 249, 404, 408

[56] References Cited

U.S. PATENT DOCUMENTS

| | | | |
|---|---|---|---|
| Re. 31,528 | 3/1984 | Mieyal . | |
| 3,304,684 | 2/1967 | Mock et al. | 52/506.07 X |
| 3,308,288 | 3/1967 | Ades | 362/150 |
| 3,969,865 | 7/1976 | Anderson | 52/506.07 |
| 4,206,578 | 6/1980 | Mieyal . | |
| 4,407,011 | 9/1983 | Lahm . | |
| 4,520,609 | 6/1985 | Worley et al. . | |
| 4,580,387 | 4/1986 | Rogers | 52/506.07 X |
| 4,794,745 | 1/1989 | Platt et al. . | |
| 4,852,325 | 8/1989 | Dunn et al. . | |
| 5,072,344 | 12/1991 | Fabbri | 362/150 |
| 5,325,647 | 7/1994 | Forry et al. . | |
| 5,893,249 | 4/1999 | Peterson et al. | 52/506.07 |
| 5,896,724 | 4/1999 | Tofts | 52/506.07 X |

OTHER PUBLICATIONS

Steel Designers' Manual, 4th ed., Collins (London, England), p. 1048–1053, (1983).

Marks, "Standard Handbook for Mechanical Engineers," 10th ed., McGraw–Hill (New York, NY), p. 5–27—5–30, (1996).

American Society for Testing and Materials, Designation: E 580–96, "Standard Practice for Application of Ceiling Suspension Systems for Acoustical Tile and Lay–in Panels in Areas Requiring Moderate Seismic Restraint," Annual Book of ASTM Standards, p. 1–5, (1996).

Uniform Building Code Standard 25–2, "Metal Suspension Systems for Acoustical Tile and For Lay–in Panel Ceilings," p. 3–782—3–788 (1994).

American Society for Testing and Materials, Designation: C 636–96, "Standard Practice for Installation of Metal Ceiling Suspension Systems for Acoustical Tile and Lay–in Panels," Annual Book of ASTM Standards (1996). p. 2–4.

American Society for Testing and Materials, Designation: C 635–95, "Standard Specification for the Manufacture, Performance, and Testing of Metal Suspension System for Acoustical Tile and Lay–in Panel Ceilings," Annual Book of ASTM Standards, (1995) p. 1–8.

*Primary Examiner*—Robert Canfield

*Attorney, Agent, or Firm*—Eugene Chovanes

[57] ABSTRACT

A beam for grid in a suspended ceiling that has an increased effective beam height over prior art beams. The beam has a peak at the top, which conforms to the shape of a standard light fixture box frame supported by the beam in the ceiling. The beam does not interfere with the proper support of the fixture frame on the beam flanges.

7 Claims, 2 Drawing Sheets

PRIOR ART
40
41
42
43
45
46
47
48
49
50
51
60
63
30
35
20
21
22
23
24
25
26
27
32
33

BEAM

BACKGROUND OF THE INVENTION

1. Field of the Invention

This invention relates to a beam for use in a grid that supports panels and ceiling fixtures in a suspended ceiling. These fixtures include fluorescent light fixtures.

The beams used in such grid are generally of an inverted T-shape in cross-sections.

2. Background Information

Prior art beams used in grids in suspended ceilings are generally of inverted T-shape, with a bulb at the top, a vertical web extending downward from the bulb, and horizontal flanges at the bottom of the web. The height of the beam from the top of a flange to the top of the bulb, which is generally rectangular in cross-section is generally limited to 1½". This beam height is so limited in order to accommodate the standard conventional fluorescent ceiling light fixture box frame.

The beams are generally formed from a flat strip of sheet metal by folding the strip along its longitudinal center.

These beams are subject to loads that tend to deflect the beams downward between beam support points, such as support wires. Such loads include acoustical panels as well as the above-mentioned lights and air diffusers. The beams must be strong enough to resist downward deflection from such loads within limits set by the controlling building codes.

In accordance with known beam design practice, the beam could be made stronger against downward deflection by increasing the web height, and/or by increasing the metal thickness from which the beam is formed. Since the web height has been set in the suspended ceiling industry at 1½" to avoid interference with the standard fluorescent light box frame, the conventional way of strengthening the beam in the prior art was to use thicker metal, including reinforcement layers within, or on the bulb, as seen in U.S. Pat. Nos. Re. 31,528; 4,520,609 and 4,852,325. Such beam construction resulted in a costlier beam.

SUMMARY OF THE PRESENT INVENTION

The beam of the invention conforms to the height requirement, established in the suspended ceiling industry, that the beam not interfere with the proper support of a standard conventional box frame of a fluorescent light fixture. The beam permits the box frame to fully rest on the beam flanges as in the prior art.

The beam of the invention is stronger in resistance to downward deflection from loading then a prior art beam made of the same thickness metal. In the alternative, the beam of the invention permits use of thinner metal than that used in forming a corresponding prior art beam, while achieving the same strength, resulting in a more economically produced beam.

Such increased strength to resist deflection is achieved by effectively increasing the web height, without interference with the light box frame. This effective increase in web height increases the moment of inertia of the beam about its horizontal axis, in cross-section.

The beam of the invention utilizes the space adjacent a transition section of the box frame to achieve this increase in effective web height and moment of inertia. The beam, which is of inverted T-shape in the manner of the prior art, has, at the top of the bulb, a symmetrical shape in the form of a peak, or angle, that conforms on each side of the peak to the shape of the transition portion of the box frame. This shape avoids interference with a light box frame supported on the beam flange on either side of the beam. The peak, or angle, effectively increases the moment of inertia, which results in a stronger beam for a given thickness of beam metal.

As understood in beam design practice, when the term "moment of inertia" is used in regard to cross-sectional area of the beam, it is equal to the sum of the products obtained by multiplying each elementary area of the cross-section by the square of its distance from the axis.

DESCRIPTION OF THE PREFERRED EMBODIMENT

Figures 1, 2:
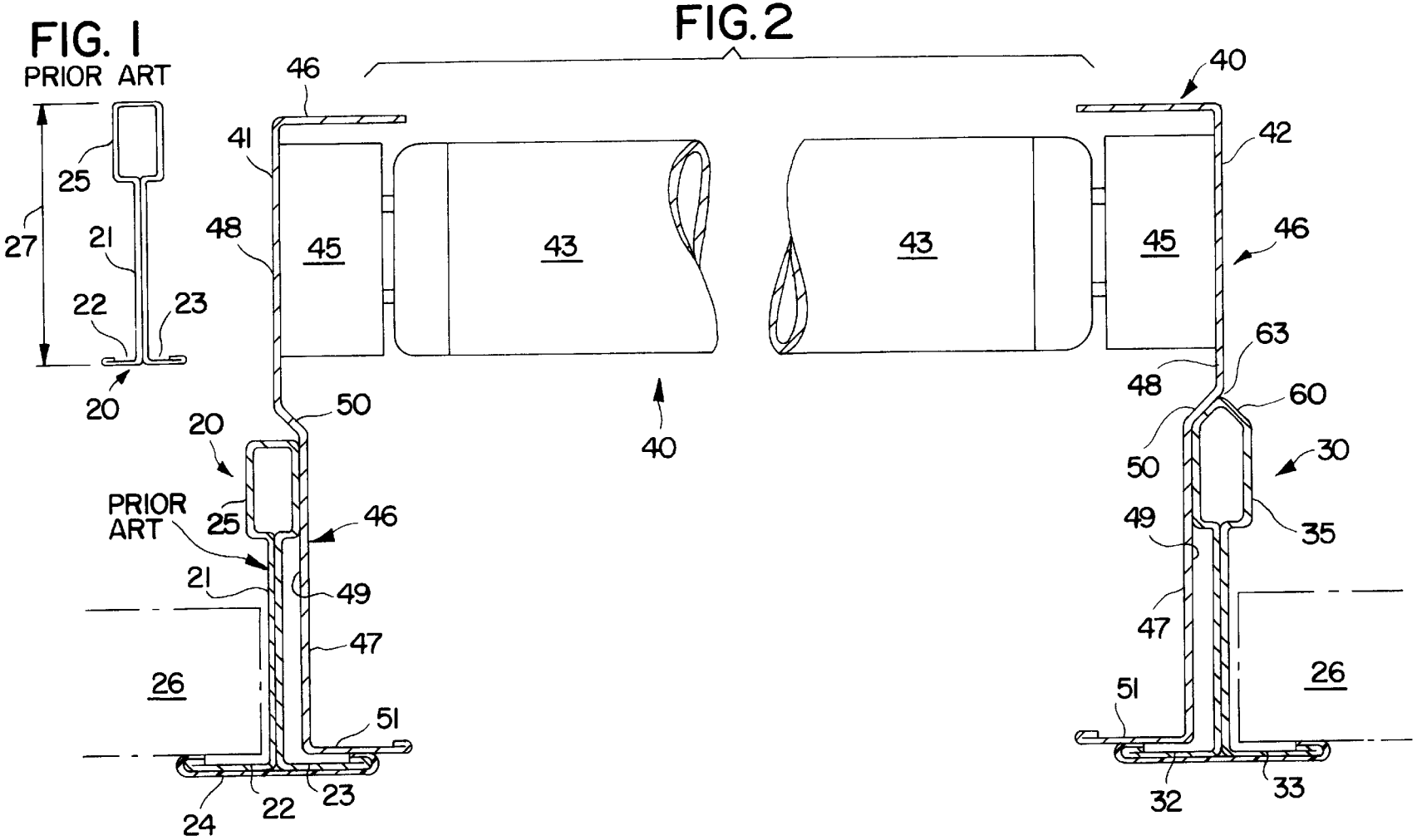
FIG. 1 PRIOR ART
FIG. 1 is an end sectional view of a prior art beam.
FIG. 2 is a partial sectional end elevation of spaced parallel main beams in a grid opening in a suspended ceiling, showing a prior art beam on the left and the beam of the invention on the right, supporting a light fixture.

As seen in FIG. 1, prior art beam 20 has a web 21, flanges 22 and 23, and a bulb 25. Beam 20 is commonly formed of a flat strip of sheet steel, which is bent symmetrically about a longitudinal center line to form a cross-section of an inverted T. Such beams are well known and are used to form rectangular grids in suspended ceiling systems. The beam, when used as a main beam in such a grid, is supported periodically by wires from the structural ceiling. The centerlines of the main beams are conventionally spaced in parallel relationship 48" apart. Cross-beams generally of the identical cross-section as the main beams, are connected to the main beams, to form 2' by 4' rectangular opening. These openings can again be subdivided into 2'×2' openings when desired by inserting more cross-beams. Such grids are well known in prior art.

Either a ceiling panel 26 or a fixture, such as fluorescent light fixture 40, is supported within each grid opening.

In FIG. 2, there is shown a fluorescent light fixture supported within a grid opening. To illustrate the invention and its difference over the prior art, there is shown a prior art beam 20 on the left side of the opening, and a beam of the invention 30 on the right side of the opening. In practice, of course, the main beams, and preferably the cross-beams, will be all that of the invention in a given ceiling grid.

Figure 3:
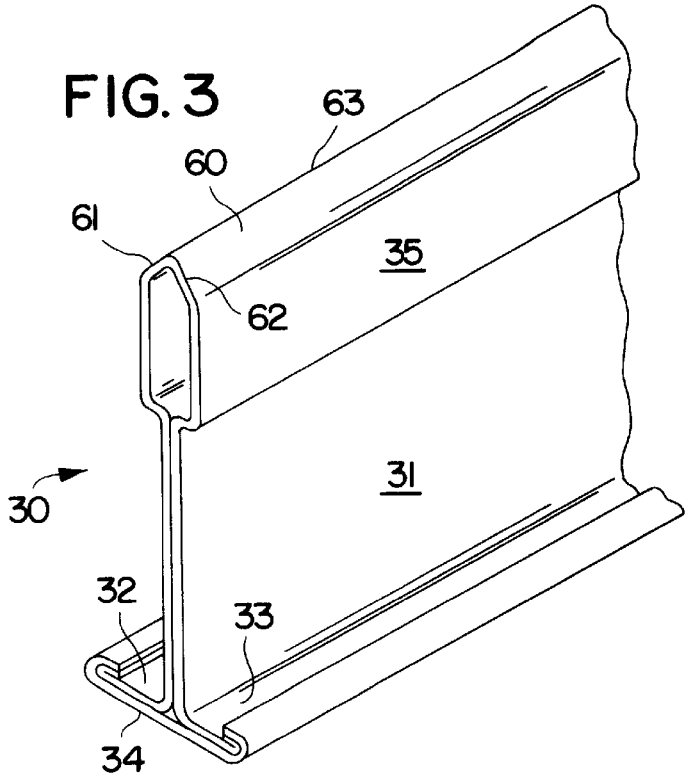
FIG. 3 is a perspective view of the end of a beam of the invention.
Figure 4:
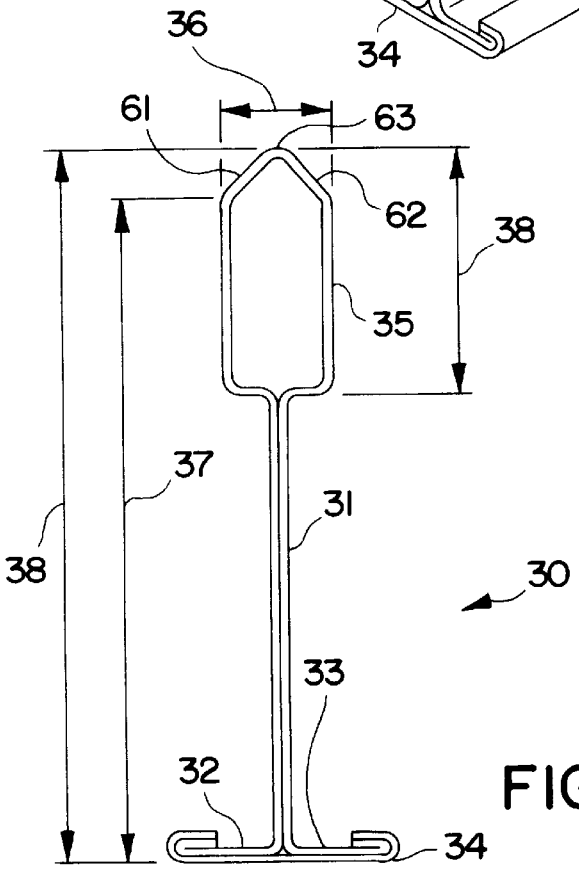
FIG. 4 is an end section of the beam of the invention showing various dimensions.

The beam 30 is shown in perspective in FIG. 3, and in a detailed end-section in FIG. 4.

As seen in FIG. 2, the light fixture 40 is of a conventional, prior art, standardized type. The overall maximum length of the fixture from end 41 to end 42 is 48". Fluorescent tube 43 and sockets 45 are fixed within a rectangular metal box frame 46 in the fixture 40.

The standard box frame 46 has as seen in FIG. 2 a lower section 47 and a larger upper section 48, connected by a transitional section 50. Such standard, well-known, and conventional construction of the box frame 46 is necessary to avoid interference between the fixture 40, which has a maximum outside dimension, end to end, of 48", at the larger upper section 48, and the parallel conventionally spaced main beams having an inside dimension of 47¾" between the bulbs of the beams, since the bulbs conventionally have a width of ¼'.

The lower section 47 of box frame 46 has inward turned feet 51 which rest on the flanges 23 and 32 of the beams as seen in FIG. 2. The relationship between the beam and the box frame 46 must be such that there is no interference with the frame resting on the flanges.

The industry that produces grid for suspended ceilings has essentially standardized on certain dimensions in a beam to accommodate the light fixture box frame 46 described in order to permit the box frame 46 to rest on the flanges of the main beam.

The length between the main beams, taken at a location between the bulbs 25 and 35 of the main beams, as stated above, and as seen in FIG. 2, is 47¾". As seen in both the prior art beam 20 in FIG. 1, and the beam 30 of the invention in FIG. 4, the width of the bulb in cross-section is ¼" or ⅛" on each side of the center line of the beam. The beam centerlines are spaced parallel to one another 48" apart. It is this projection of the bulb of a runner into the space between main beams, in a conventional suspended ceiling, that has been compensated for by the conventional, standardized shape of the light box frame 46. In a conventional, standard, light fixture 40, the distance between ends 49 of the lower section 47 of the box frame 46 of the fixture 40, as seen in FIG. 2 in a standard box frame, is 47½".

The height of the lower portion 47 of the standard box frame from the lower side of the legs 51 to the lower end f the transition portion 50 of the box frame is 1½".

It is this distance that has limited the height of the prior art beam 20 to 1½" to avoid interference with the transitional portion 50 of the frame 46.

The beam 30 of the invention is identical to certain portions of the corresponding prior art beam 20. Web 31 extends upwardly from flanges 32 and 33 to form bulb 35. A lower cap 35, corresponding to lower cap 25, can optionally be applied to the flanges.

The width 36 of bulb 35 is ¼" which again conforms to prior art conventional constructions.

The portion within the distance line 37 of the present beam 30 substantially conforms in all aspects to the prior art beam 20 designated by the distance line 27, including dimensions, except for the very top of the bulb 25. The bulb 35 of the invention 30 does not have the relatively flat top of prior art bulb 35.

The dimension indicated by lines 27 on the prior art beam 20 is 1.5", whereas the exact dimension 37 of the present beam is 1.549".

The beam 30 of the present invention has a peak 60 or angle conformation added to the top of the bulb 35 beyond the former 1½" height limit. The peak has an apex at 63. Each side of this peak 60 closely conforms to the transition portion 50 of the box frame 46 as seen particularly at the right hand side of FIG. 2. This transition portion 50 consists of a flat segment inclined at about 45° to the vertical. Such peak 60 has an interior included angle of approximately 90°, with the slope of the surface on each side 61 and 62 of the peak 60 being at an incline of about 45° from the vertical that conforms to the incline of the transition portion 50. As seen in FIG. 4, such construction in the beam of the invention yields an overall height 38 of about 1.67" and a bulb height of 0.580" when the beam 40 is formed of sheet metal 0.010 inches thick, as seen in FIG. 5.

The present beam 30 by means of the peak 60, with a side that conforms to the transition portion 50 of the box frame 46, provides beam support as described above wherein feet 51 of the box frame 46 rest on the beam flanges 32 or 33, without interfering with such positioning of the frame. The beam 30 permits a frame 46 to be inserted on either side of the beam 30.

The beam 30 of the present invention has a moment of inertia, computed on beam design principles, which results in a beam that has a greater resistance to deflections than does the prior art beam made of the same thickness metal. In the alternative, the beam 30 of the invention can be made of thinner material, to achieve the same strength to resist deflections, than the materials used in a prior art beam of the same strength.

Figure 5:
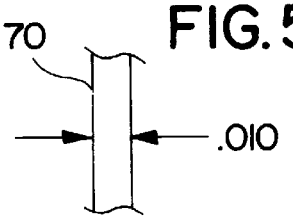
FIG. 5 is a fragmentary end view of a representative metal thickness used in the beam of the invention.
Figure 6:
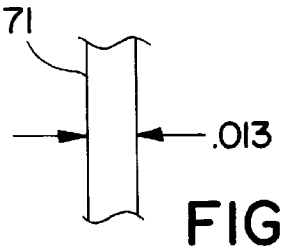
FIG. 6 is a fragmentary end view of a metal thickness used in a prior art beam to achieve the strength of a beam of the invention using the metal thickness of FIG. 5.

As an example, a beam 30 of the invention can be made of 0.010" thickness metal 70 as seen in FIG. 5, and achieve the same strength against downward deflection as a prior art beam 20 made of the same quality sheet metal having a thickness of 0.013" as seen at 71 in FIG. 6. Such reduction in sheet metal thickness results in significant economic savings, since beams of this type herein described are produced in large numbers.

I claim:

1. In a suspended ceiling having, in combination, a) a grid formed of spaced beams and b) a fluorescent light fixture supported by some of the beams;

wherein a) the beams in cross-section are identical and of an inverted T-shape having a vertical web, horizontal flanges at the bottom of the web, and a bulb at the top of the web, b) the light fixture has a box frame having a lower portion and a transitional portion above the lower portion to permit the frame to fit between the spaced beams and to be supported on the flanges of the beams, and c) the beams have a beam height effective in resisting bending loads on the beams, wherein said beam height does not interfere with the fit of the frame between the beams and support of the frame on the flanges;

the improvement comprising a group of beams identical in cross-section, each capable of being assembled with the others in the group to form the grid, wherein each of the beams in the group has a shape at the top that conforms in shape in cross-section of the transitional portion in cross-section on the light fixture frame, said shape at the top of the beam extending above the frame lower portion into a space adjacent the transitional portion of the light frame when the beams support the frame on the beam flanges, without interfering with the fit of the frame between the beams, or support of the frame on the beam flanges.

2. The improvement of claim 1 wherein said shape on the beam is in the form of a peak that has sloping sides forming an included angle of about 90°, and each side of the peak forms an included angle of about 45° with the vertical.

3. The improvement of claim 1 wherein the sides of the bulb include portions that are generally parallel and spaced about ¼" apart.

4. The improvement of claim 3 wherein the peak extends the height of the beam at the apex of the peak to about ⅛" above the height of box frame lower portion.

5. The beam of claim 1 wherein the beam is formed from a strip of flat metal sheet metal folded about the longitudinal axis.

6. In a suspended ceiling, in combination, a) a grid in the ceiling formed of interconnected beams, each of the beams having an identical cross-section in the form of an inverted T with a vertical web, a bulb on top of the web, and horizontal flanges extending from the web at the bottom, the beam having a beam height effective in resisting bending from loads on the beam; and b) a fluorescent light fixture box frame in the ceiling having a lower portion, a transitional portion, and an upper portion larger than the lower portion, supported on the grid;

the improvement comprising beams in grid, wherein a beam has a top in a shape that conforms in cross section to the shape of the transitional portion of the frame, wherein, in the combination, the shape of the beam at the top a) permits the box frame to be supported vertically on the flange of the beam without interference; and b) occupies the space horizontally adjacent the transitional portion of the frame in the combination.

7. In a suspended ceiling having, in combination, a) a grid formed of spaced beams and b) a fluorescent light fixture supported by some of the beams;

wherein a) the beams in cross-section are identical and of an inverted T-shape having a vertical web, horizontal flanges at the bottom of the web, and a bulb at the top of the web, b) the light fixture has a box frame having a lower portion and a transitional portion above the lower portion to permit the frame to fit between the spaced beams and to be supported on the flanges of the beams, and c) the beams have a beam height effective in resisting bending loads on the beams, wherein said beam height does not interfere with the fit of the frame between the beams and support of the frame on the flanges;

the improvement comprising a method of increasing the beam height effective in resisting bending loads on the beams by a) forming the top of the beam in a shape conforming in cross section to the shape of the transitional portion of the box frame; and b) extending the beam height above the frame lower portion into a space adjacent the transitional portion of the box frame so that the shape of the beam at the top and the transitional portion exist side by side without interfering with one another.

* * * * *

UNITED STATES PATENT AND TRADEMARK OFFICE

CERTIFICATE OF CORRECTION

PATENT NO. : 6,138,416
DATED : October 31, 2000
INVENTOR(S) : William J. Platt

It is certified that error appears in the above-identified patent and that said Letters Patent is hereby corrected as shown below:

Column 4,
Line 51, delete [of] and insert -- to --.

Column 5,
Line 17, after "in" and before "grid", insert -- the --.

Signed and Sealed this

Fourth Day of December, 2001

*Attest:*

Nicholas P. Godici

NICHOLAS P. GODICI
*Acting Director of the United States Patent and Trademark Office*

*Attesting Officer*